US005923347A

United States Patent [19]

Wade

[11] Patent Number: 5,923,347

[45] Date of Patent: Jul. 13, 1999

[54] METHOD AND SYSTEM FOR CLEANING AN INK JET PRINTHEAD

[75] Inventor: Thomas F. Wade, Rochester, N.Y.

[73] Assignee: Xerox Corporation, Stamford, Conn.

[21] Appl. No.: 08/788,309

[22] Filed: Jan. 24, 1997

[51] Int. Cl.[6] ..... B41J 2/165

[52] U.S. Cl. ..... 347/28; 347/25

[58] Field of Search ..... 347/25, 28, 85; 134/22, 18, 184; 15/404

[56] References Cited

U.S. PATENT DOCUMENTS

| | | | |
|---|---|---|---|
| 4,148,041 | 4/1979 | Rosenstock | 347/28 |
| 4,546,363 | 10/1985 | Iwagami | 347/28 |
| 4,571,599 | 2/1986 | Rezanka | 347/87 |
| 4,638,337 | 1/1987 | Torpey et al. | 347/65 |
| 4,849,769 | 7/1989 | Dressler | 347/27 |
| 4,849,774 | 7/1989 | Endo et al. | 347/56 |
| 4,923,374 | 5/1990 | Lundin et al. | 417/440 |
| 5,160,945 | 11/1992 | Drake | 347/42 |
| 5,210,550 | 5/1993 | Fisher et al. | 347/30 |
| 5,289,212 | 2/1994 | Carlotta | 347/87 |

FOREIGN PATENT DOCUMENTS

| | | | |
|---|---|---|---|
| 4-28559 | 1/1992 | Japan | 347/25 |

*Primary Examiner*—Joseph Hartary
*Assistant Examiner*—Craig A. Hallacher

[57] ABSTRACT

An improved method and apparatus is provided for cleaning an ink jet printhead following a print operation. A source of pressure is applied to the printhead nozzle face via a resilient sealing cap member. The printhead manifold is connected to a reservoir which is filled with cleaning fluid. The cleaning fluid is introduced into the printhead interior. The pressure source is activated for short time periods and at a low pressure forces air into the interior of the printhead. This creates an agitation of the cleaning mixture and a bubbling effect which causes residual ink within the printhead to be mixed with the cleaning fluid and carried through the ink manifold back into the ink tank. The operation can be repeated until all of the residual ink is purged from the printhead interior.

5 Claims, 2 Drawing Sheets

METHOD AND SYSTEM FOR CLEANING AN INK JET PRINTHEAD

BACKGROUND OF THE INVENTION AND MATERIAL DISCLOSURE STATEMENT

The present invention relates to a method and system for cleaning an ink jet printhead following a print operation. More particularly, the invention relates to a procedure wherein ink in the interior of the printhead is removed by air circulated under pressure through a printhead filled with a cleaning fluid.

An ink jet printer of the so-called "drop-on-demand" type has at least one printhead from which droplets of ink are directed towards a recording medium. Within the printhead, the ink may be contained in a plurality of channels and energy pulses are used to cause the droplets of ink to be expelled, as required, from orifices at the ends of the channels.

In a thermal ink jet printer, the energy pulses are usually produced by resistors, each located in a respective one of the channels, which are individually addressable by current pulses to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then refilled by capillary action, which in turn draws ink from a supply container. Operation of a thermal ink jet printer is described in, for example, U.S. Pat. No. 4,849,774.

Commercial ink jet printers utilize a print cartridge comprising a printhead connected to an ink source via a manifold. The ink source is typically an ink bag or an ink tank or cartridge. At various times, it is desirable to clean the printhead following a print operation. It is known in the art to clean and reprime a printhead following a period of print operation. Typically, the printhead is mounted on a carriage which is periodically moved to a maintenance station where a cleaning mechanism engages the printhead to clean the printhead face and reprime the printhead.

U.S. Pat. No. 4,849,769 describes an ultrasonic cleaning method for removing particles from a printhead orifice plate. U.S. Pat. No. 5,210,550 discloses a maintenance station which primes a printhead and periodically stores the printhead in a humid environment For some usages, it may be necessary to periodically provide a more thorough cleaning of the printhead including removal of ink from interior ink pathways (channels) and nozzles as well as the ink manifold. This thorough cleaning becomes a positive requirement when a printhead, following manufacture, is initially tested prior to shipping to a remote site. The printhead must be thoroughly cleaned following the print test and prior to shipping so as to remove ink that is still within the interior passageways and nozzles and any other particulate matter which could affect ink ejection and performance. From the above comments, it is necessary to clean a printhead outside of the conventional maintenance station. Known procedures are to manually introduce a flushing medium into the printhead manifold and flush the ink out through the nozzles. An automated cleaning method is disclosed in copending application U.S. Ser. No. 08/673,479 filed on Jul. 1, 1996, and assigned to the same assignee as the present invention. This reference describes a cleaning method wherein a water/gas mixture is forced into the printhead manifold and through the interior of the printhead, the mixture effectively flushing out residual ink within the printhead through the nozzles.

All of the references identified above are hereby incorporated by reference.

These methods are not completely effective and/or require complex cleaning systems.

SUMMARY OF THE INVENTION

It is a main object of the invention to improve the cleaning of a printhead following a print usage.

The invention is directed to a cleaning method which includes filling an ink reservoir which ordinarily introduces ink into the printhead through a manifold, with a cleaning fluid. Some of the fluid is introduced into the printhead interior. Air is then introduced into the front nozzles of the printhead at a low pressure, in a preferred embodiment, by a series of repeatable pressurizing pulses. This action agitates the ink within the printhead creating a bubbling effect dislodging ink particles and transporting them as an ink/cleaning fluid mixture through the manifold back into the cleaning liquid reservoir. It has been found that any ink remaining in the printhead is effectively flushed into the reservoir which can then be emptied and reused.

More particularly, the present invention relates to a method for cleaning an ink jet printhead of residual ink within the interior of the printhead, the printhead being of the type that expels ink droplets from nozzles onto a recording medium, comprising the steps of:

- connecting a cleaning fluid reservoir to an inlet of the printhead,
- transferring cleaning fluid from the reservoir into the printhead interior via said inlet,
- introducing air from a pressure source into the nozzles of the printhead to agitate the cleaning fluid within the printhead and
- continuing to apply said pressure until residual ink is removed by the agitated cleaning fluid, the ink/fluid mixture being forced back into the cleaning fluid reservoir.

DESCRIPTION OF THE INVENTION

The principles of the present invention apply to the cleaning of various types of printheads supplied with ink from a variety of sources. The generic structure of the printhead to be cleaned includes a manifold member which fluidly feeds ink from an ink reservoir into the interior channels of the printhead. The ink is expelled through nozzles upon application of heat to a resistor in the channel (for thermal ink jet printing) or application of a voltage across a transducer to construct the ink filled channels causing the ink ejection (piezoelectric ink jet printing). The ink reservoir can be an ink bag, a housing (tank) which is conventionally filled with ink or with an ink impregnated foam. With any of these reservoirs, an ink exit port is fluidly and sealingly connected to the ink manifold of the printhead and thereby allowing ink to be introduced into the interior ink pathways of the printhead.

Figure 1:
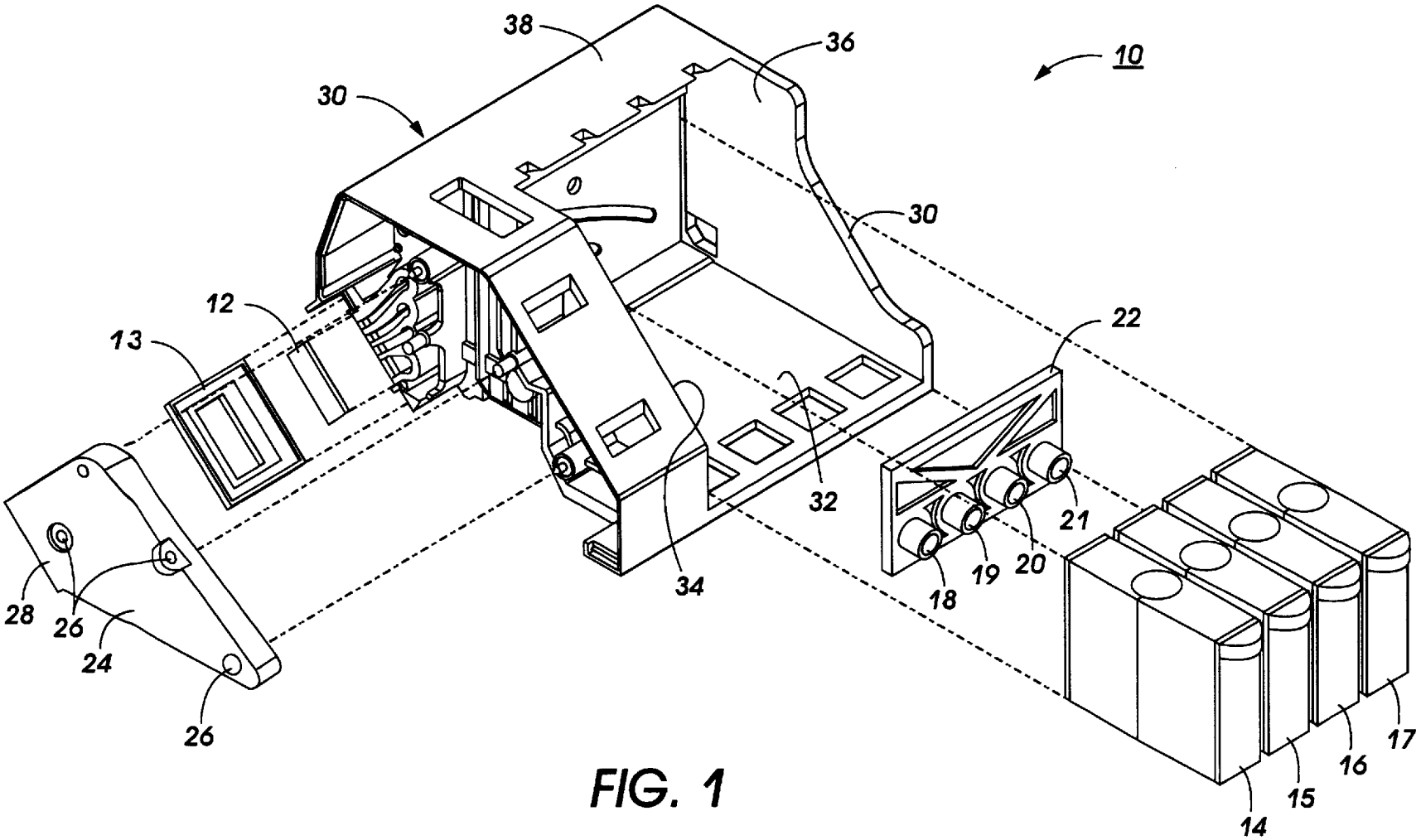
FIG. 1 is a partially exploded view of an exemplary printhead cartridge assembly cleaned by the present invention.

FIG. 1 shows an exploded view of a color printhead assembly of the type wherein ink is supplied from an ink-filled foam contained within a plurality of ink tanks.

Specifically, color printhead assembly 10 comprises a segmented printhead 12 which has four segments, or groups, of nozzles (not visible), each group associated with printing ink of a different color onto a recording medium. The printhead segments are fabricated by methods known in the art and disclosed, for example, in U.S. Pat. No. 4,638,337, whose contents are hereby incorporated by reference. As described therein, printhead 12 is formed by bonding together a channel plate to a heater plate forming interior channels, each channel in thermal communication with a resistor element. Nozzles are formed on the front face of the printhead and overlain with a nozzle plate 13. Ink from ink tanks 14, 15, 16, 17 is supplied via ink pipes 18, 19, 20, 21, respectively, of manifold 22 to the associated segments of printhead 12. The ink is filtered and sealed from leakage by internal seals and filters not visible. Upon selective pulsing of the resistive elements in the channels, ink in the channels is heated and expelled through the nozzles of the particular recording printhead segment.

To complete the description of assembly 10, the printhead is bonded to heat sink 24 which has three holes 26 formed in surface 28 for purposes to be discussed later. The heat sink and manifold are mounted on a housing frame 30 which has a floor 32 which seats the manifold and the ink cartridges. The housing also has side walls 34, 36 and a partial roof 38. The printhead 12 and housing frame 30, minus the tanks will be referred to as printhead housing assembly.

The ink tanks 14–17 are shown removed from the frame 30. For purposes of description, it is assumed that the tanks had been installed during a print/test mode and been successfully tested and the cartridges have been partially or completely exhausted of ink.

The printhead assembly 10 is to be packed and shipped to a location where it will be installed in a printer with new cartridges. It is, therefore, necessary at this point to thoroughly clean the printhead, the manifold and the internal ink paths connecting the manifold to the printhead nozzles.

According to the invention, ink tanks 14–17 are replaced by identical tanks 14A, 15A, 16A, 17A filled instead of ink with a cleaning agent such as water in a preferred embodiment. The tanks are connected to the printhead in the same manner as ink tanks 1417 as described above. The printhead is then vacuum primed in a conventional manner at a maintenance station to introduce cleaning fluid into the interior areas of the printhead.

Figure 2:
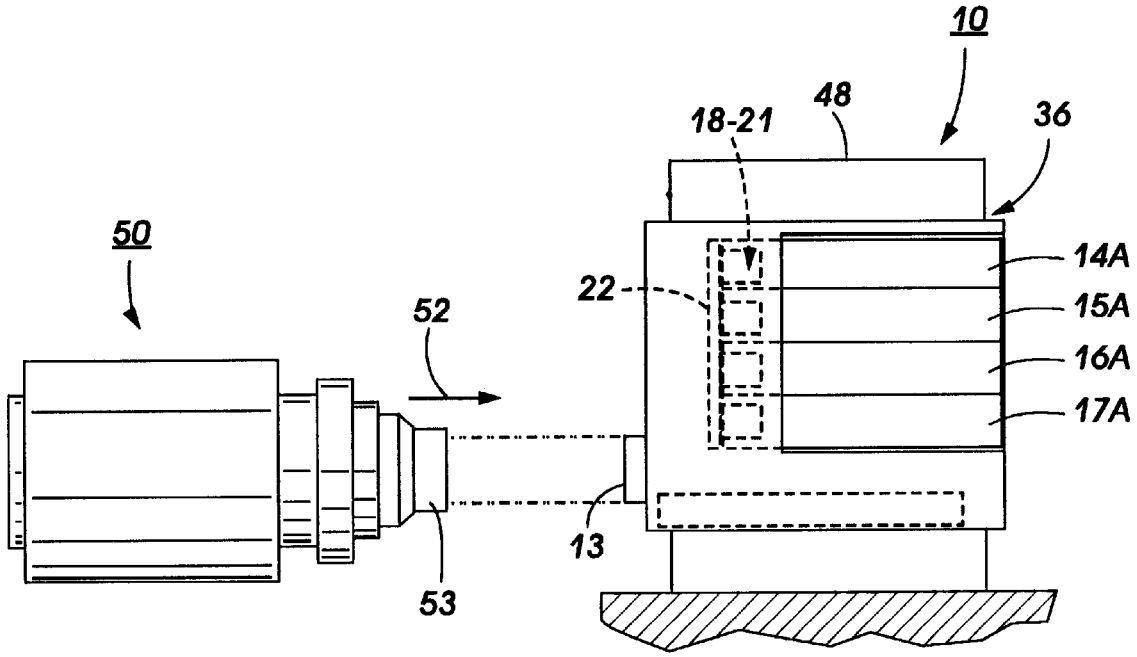
FIG. 2 is a side view of the assembly of FIG. 1 placed in a cleaning position.

FIG. 2 shows in schematic form the assembled printhead 10 of FIG. 1 rotated by 90°. A air pump 50 is moved in the direction of arrow 52 until a gasket cap 53 is sealingly engaged over nozzle plate 13. This engagement of the air pump assembly 50 can be done either manually or in an automated procedure.

Ink tanks 14A–17A are sealingly seated over ink pipes 18–21 of manifold 22. Each tank has a valve to enable air to exit and, optionally, a small cap to allow for fluid s replacement. In a test of the inventive concept, ink tanks with a fluid capacity of 50 ml was used. The air pump 50 was then turned on to apply a low pressure of between 3 and 10 and preferably 5 psi) volume of air through the nozzles into the interior areas of the printhead. The introduction of air caused agitation of the cleaning fluid forming bubbles which removed the residual ink from the interior surfaces after about 30 seconds. This process caused the ink/fluid/bubble mixture to move towards the rear of the printhead and eventually back into the reservoir. A vacuum prime was then applied to the nozzle face to remove any water remaining in the channels.

The pump may be operated to form a steady stream of air through the nozzles or alternatively, the pump can be turned on and off (pulsed) for short periods of time to introduce the air in a series of pulses. For the pulsed technique, a 5 psi pressure is applied for three seconds with a two second off interval The sequence was repeated to obtain a total cleaning time of about 30–40 seconds. For either technique, the pump operation continues until all the ink is flushed from the printhead into the tank. The tank can then be emptied, cleaned and reused; or alternatively, the purging procedure can be repeated. The procedure may be repeated by changing or cleaning a reservoir and reconnecting the tank and again introducing some cleaning fluid into the interior of the printhead.

To summarize the cleaning operation, a tank normally used to introduce ink into the reservoir is filled instead with a cleaning fluid, and the tank is sealingly engaged to the entrance manifold of the printhead. A pressure device such as an air pump (or a bellows or other pressure producing device) is sealingly engaged at the nozzle face of the printhead. Either a steady, or pulsed, application at the nozzle face creates a bubbling effect within the printhead, resulting in an efficient cleaning of residual ink within the printhead interior and flushing of the ink into the ink tanks. A vacuum prime is applied to remove fluid from the printhead interior. It is apparent that this procedure could be performed manually or can be automated by procedures familiar to those skilled in the art.

While the invention was described in the context of cleaning a color printhead assembly with four separate ink cartridges and a single segmented printhead, it is understood that the invention is applicable to other types of printhead cartridge assemblies. For example, the color printhead assembly could include four ink cartridges, each with its associated individual printheads as disclosed, for example, in U.S. Pat. No. 4,571,599. As another example, the cleaning method can be used to clean full width ink jet printheads of the type disclosed, for example, in U.S. Pat. No. 5,160,945. As a still further example, the cleaning method can be used to clean a single color printhead with an associated cartridge as disclosed, for example, in U.S. Pat. No. 5,289,212. For these, and other printhead constructions, appropriate ink reservoirs are used to introduce the cleaning mixture into the specific manifold design of the printhead to be cleaned. One skilled in the art can modify the interface member so as to introduce the cleaning fixture into the printhead interior. And, while the invention was described in the content of cleaning a printhead prior to shipment to a customer, it is understood that cleaning methods could be used to periodically clean a printhead or printheads following a prescribed operational time.

While the embodiment disclosed herein is preferred, it will be appreciated from this teaching that various alternative, modifications, variations or improvements therein may be made by those skilled in the art, which are intended to be encompassed by the following claims.

What is claimed is:

1. A method for cleaning an ink jet printhead, having an inlet, of residual ink within an interior of the printhead, the printhead having nozzles from which ink droplets are expelled, comprising the steps of:

connecting a cleaning fluid reservoir to the inlet of the printhead, transferring cleaning fluid from the reservoir into the printhead interior through said inlet, introducing air from a pressure source into the nozzles of the printhead to agitate the cleaning fluid within the printhead, to create a bubbling effect which results in formation of a fluid mixture consisting of the cleaning fluid, bubbles and residual ink and continuing to apply said pressure until all residual ink is removed, the mixture being forced back into the cleaning fluid reservoir.

2. The method of claim 1 wherein air introduced from said pressure source is introduced as a series of pulses.

3. The method of claim 2 wherein said series of pulses are within a range of approximately 3 to 10 psi.

4. A cleaning system for removing residual ink from an interior of an ink jet printhead following a print operation, the printhead having an inlet and further having nozzles from which ink droplets are expelled, the system including:

a cleaning fluid reservoir attached to the inlet of the printhead to supply cleaning fluid to the interior of the printhead, a source of air pressure sealingly attached to the nozzles of the printhead to introduce air into the printhead interior to agitate the cleaning fluid to create a bubbling effect which results in formation of a fluid mixture consisting of the cleaning fluid, bubbles and residual ink thereby dislodging residual ink and flushing the mixture back into the reservoir.

5. The system of claim 4 further including means for periodically activating the source of air pressure to introduce air in a series of pulses into the printhead, the pulses having a pressure within a range of approximately 3 to 10 psi.

* * * * *